US005606144A

United States Patent [19]

Dabby

[11] Patent Number: 5,606,144

[45] Date of Patent: Feb. 25, 1997

[54] METHOD OF AND APPARATUS FOR COMPUTER-AIDED GENERATION OF VARIATIONS OF A SEQUENCE OF SYMBOLS, SUCH AS A MUSICAL PIECE, AND OTHER DATA, CHARACTER OR IMAGE SEQUENCES

[76] Inventor: Diana Dabby, 550 Memorial Dr., #14D, Cambridge, Mass. 02139

[21] Appl. No.: 254,681

[22] Filed: Jun. 6, 1994

[51] Int. Cl.[6] ..... A63H 5/00; G10H 1/26; G10H 5/00

[52] U.S. Cl. ..... 84/649; 84/609

[58] Field of Search ..... 84/609, 610, 634, 84/649, 650

[56] References Cited

U.S. PATENT DOCUMENTS

| | | | |
|---|---|---|---|
| 5,003,860 | 4/1991 | Minamitaka | 84/609 |
| 5,281,754 | 1/1994 | Farrett et al. | 84/609 |
| 5,331,112 | 7/1994 | Sato et al. | 84/609 |
| 5,371,854 | 12/1994 | Kramer | 395/2.79 |
| 5,418,323 | 5/1995 | Kohonen | 84/609 |

*Primary Examiner*—William M. Shoop, Jr.
*Assistant Examiner*—Jeffrey W. Donels
*Attorney, Agent, or Firm*—Rines & Rines

[57] ABSTRACT

A procedure for generating different variations of a sequence of symbols, such as a musical piece, based on the properties of a chaotic system—most notably, sensitive dependence on the initial condition—is described and demonstrated. This method preferably uses a fourth order Runge-Kutta implementation of a chaotic system. Bach's *Prelude in C Major* from the *Well-Tempered Clavier, Book I* serves as the illustrative example since it is well-known and easily accessible. Variations of the Bach can be heard that are very close to the original while others diverge further. The system is designed for composers who, having created a through-composed work or section, would like to further develop their musical material. The composer is able to interact with the system to select various versions and change them, if desired. Yet the compositional character of the variations remains within the artist's domain of style, expression and inventiveness. The procedure, however, is more generically applicable to other dynamic symbol sequences than music, as well.

18 Claims, 9 Drawing Sheets

An Exemplary Algorithm of the Chaotic Mapping.

Figure 1: An Example of the Mapping.
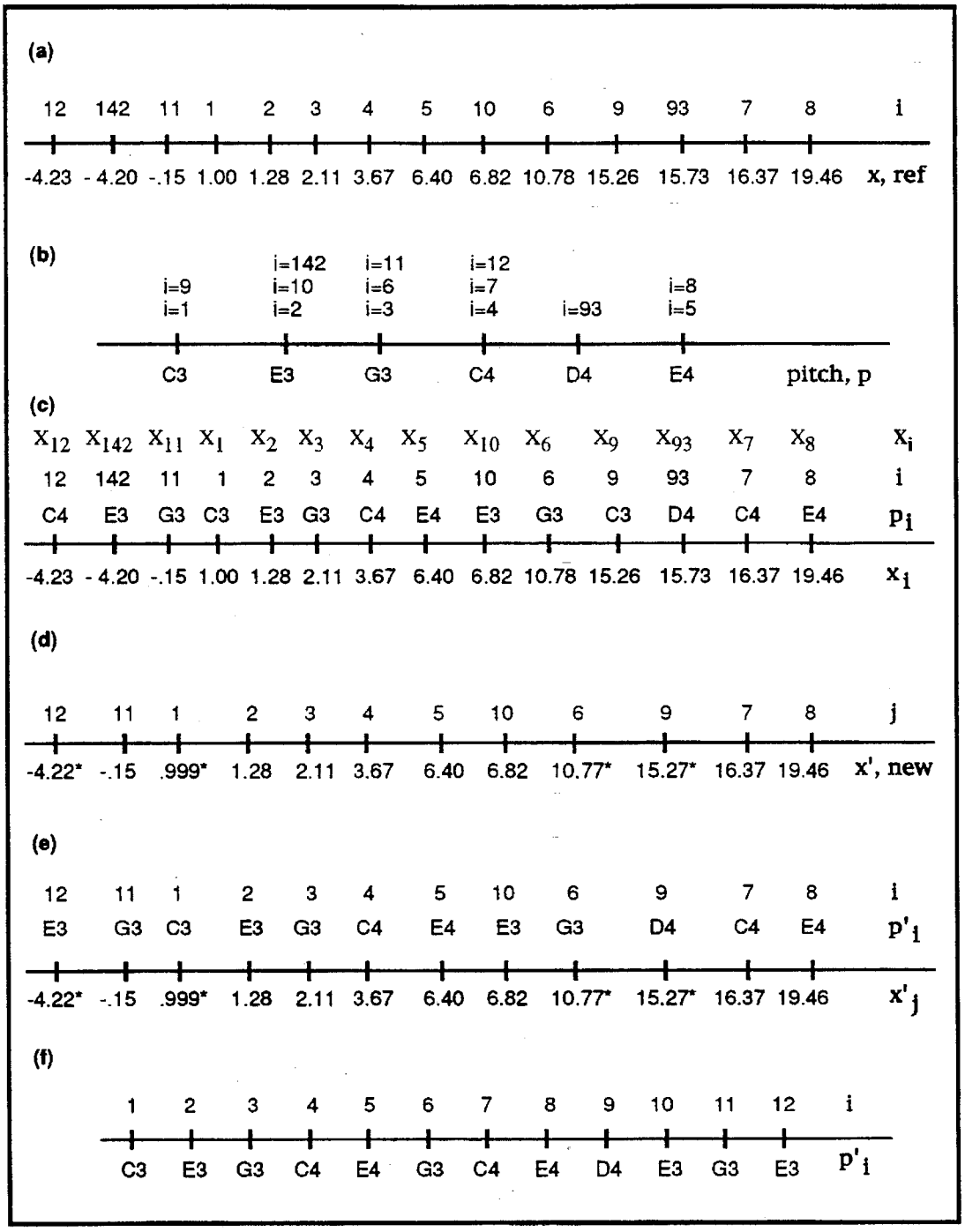

Figure 2a: Bach's Prelude in C (WTC I).
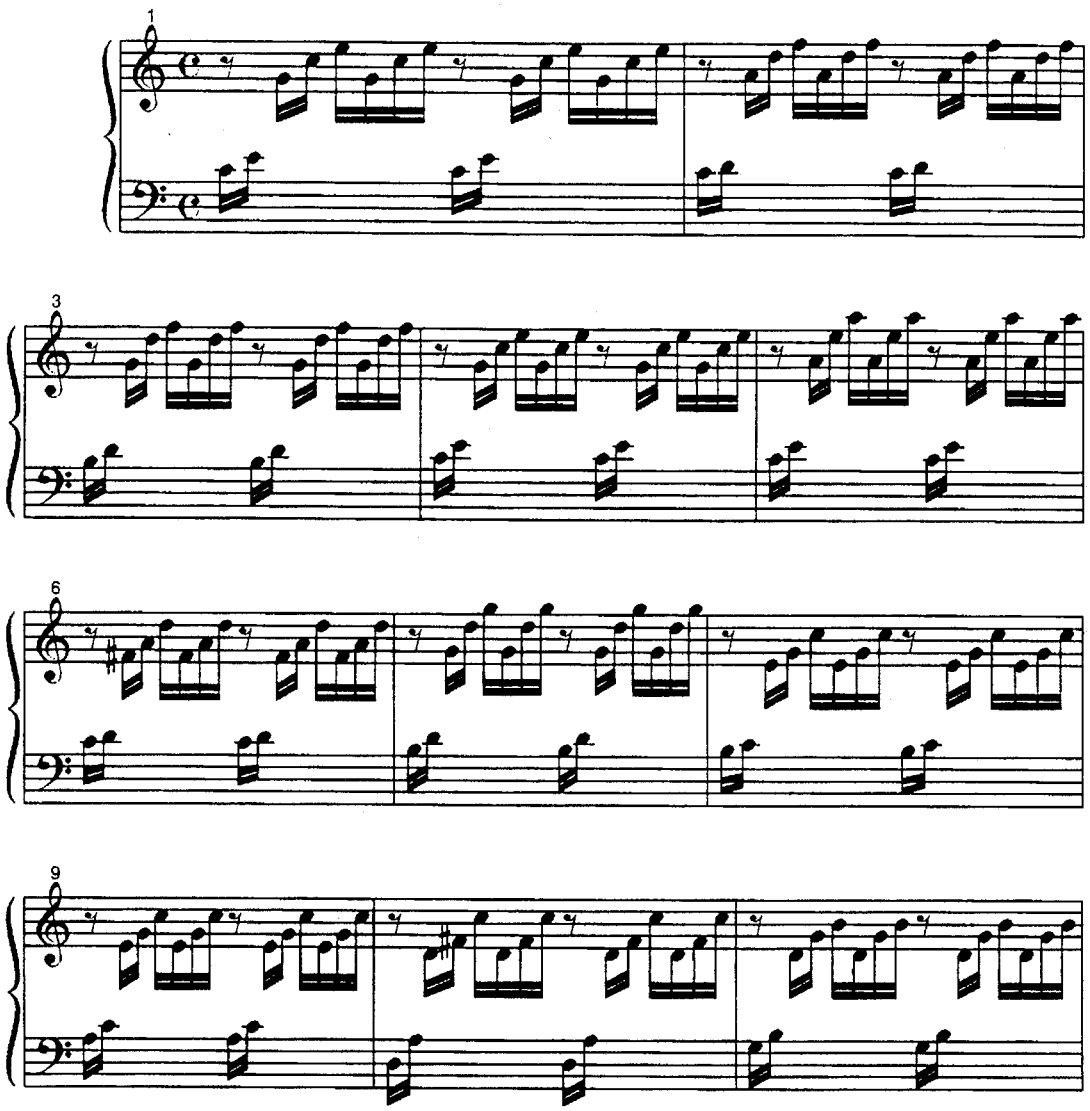

Figure 2b: Variation 1.
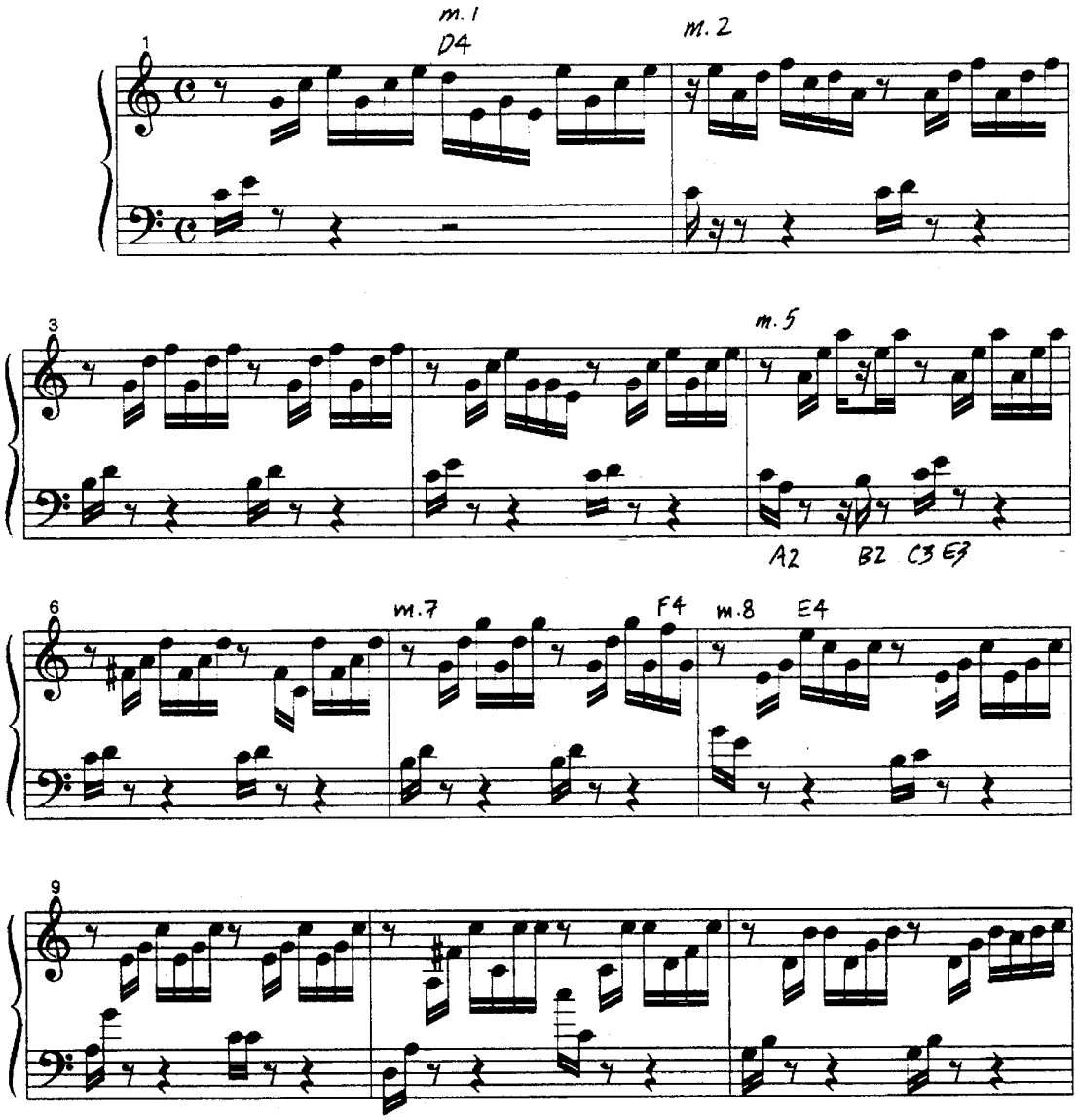

Figure 2c: Variation 2.
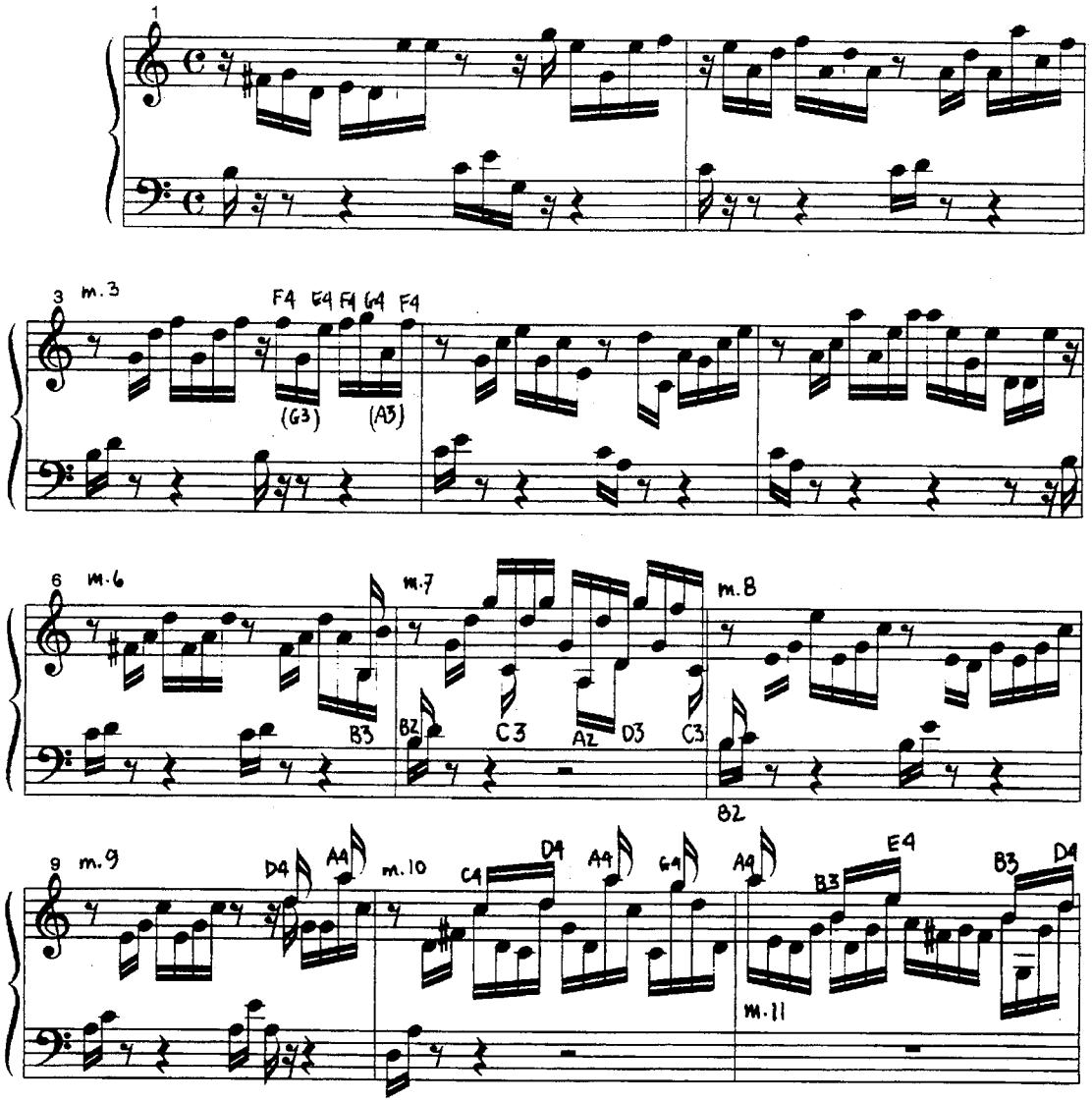

Figure 2d: Variation 3.
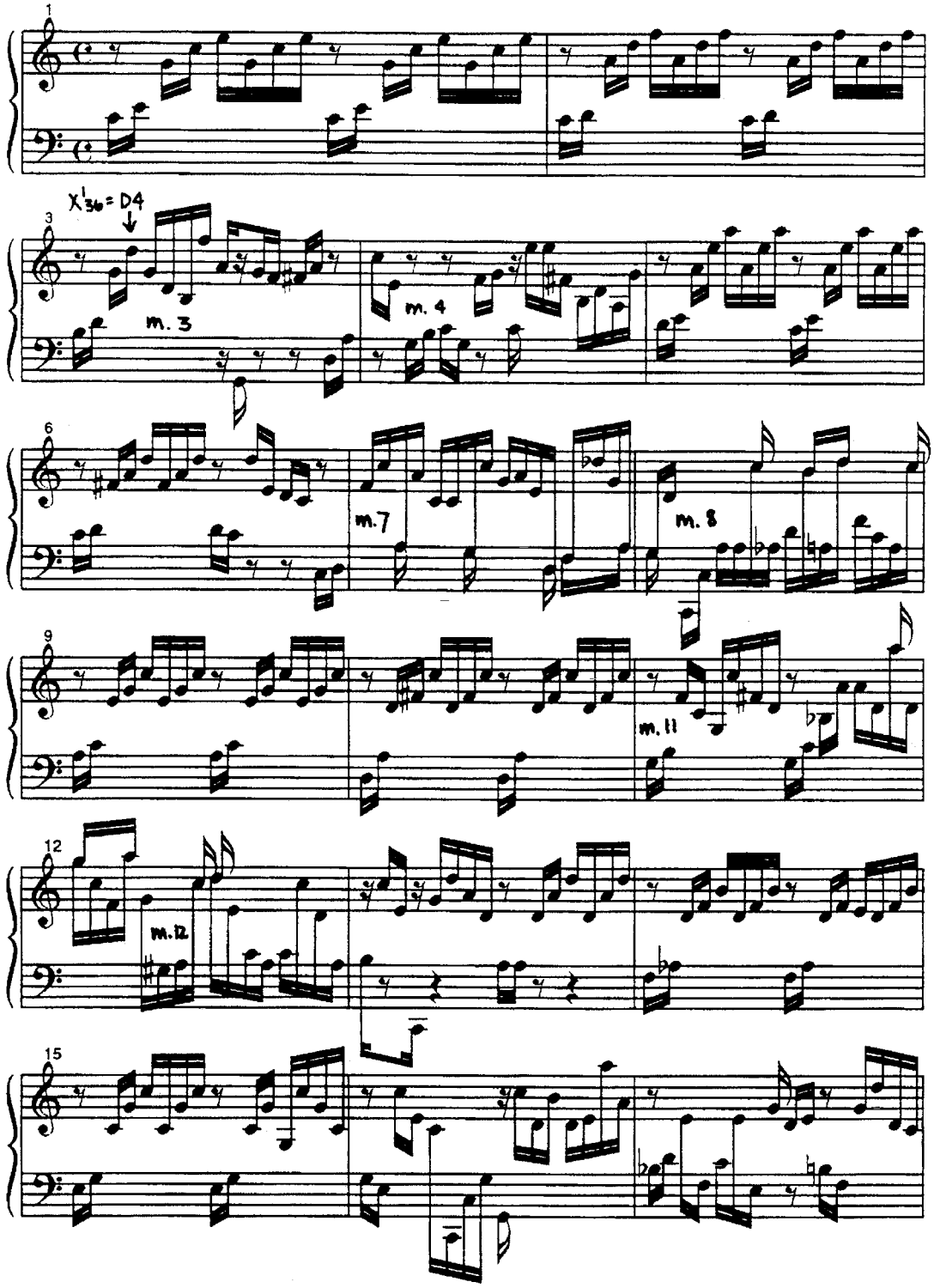

Figure 2d: Variation 3 (cont'd).
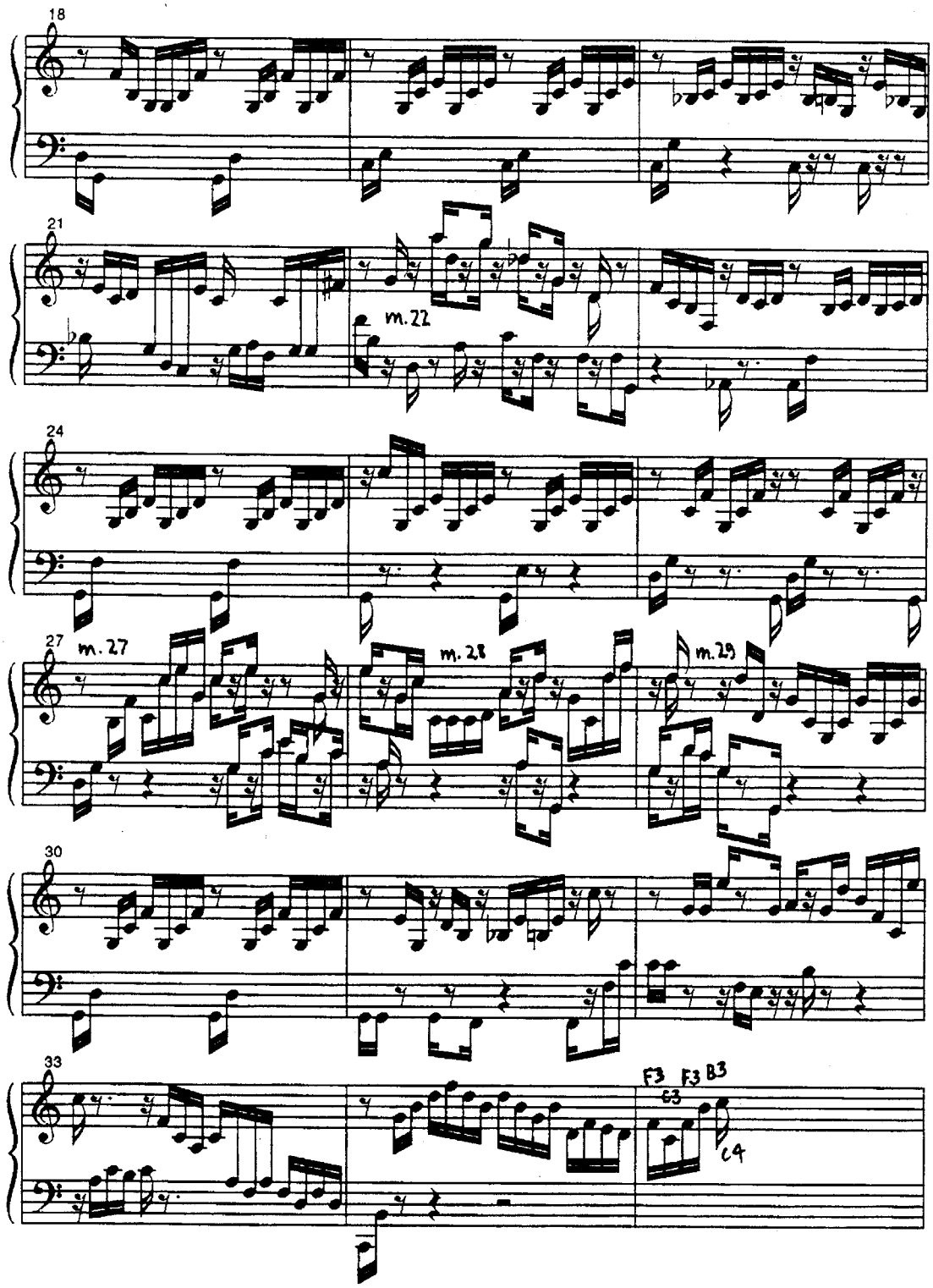

Figure 3: A Block Diagram.
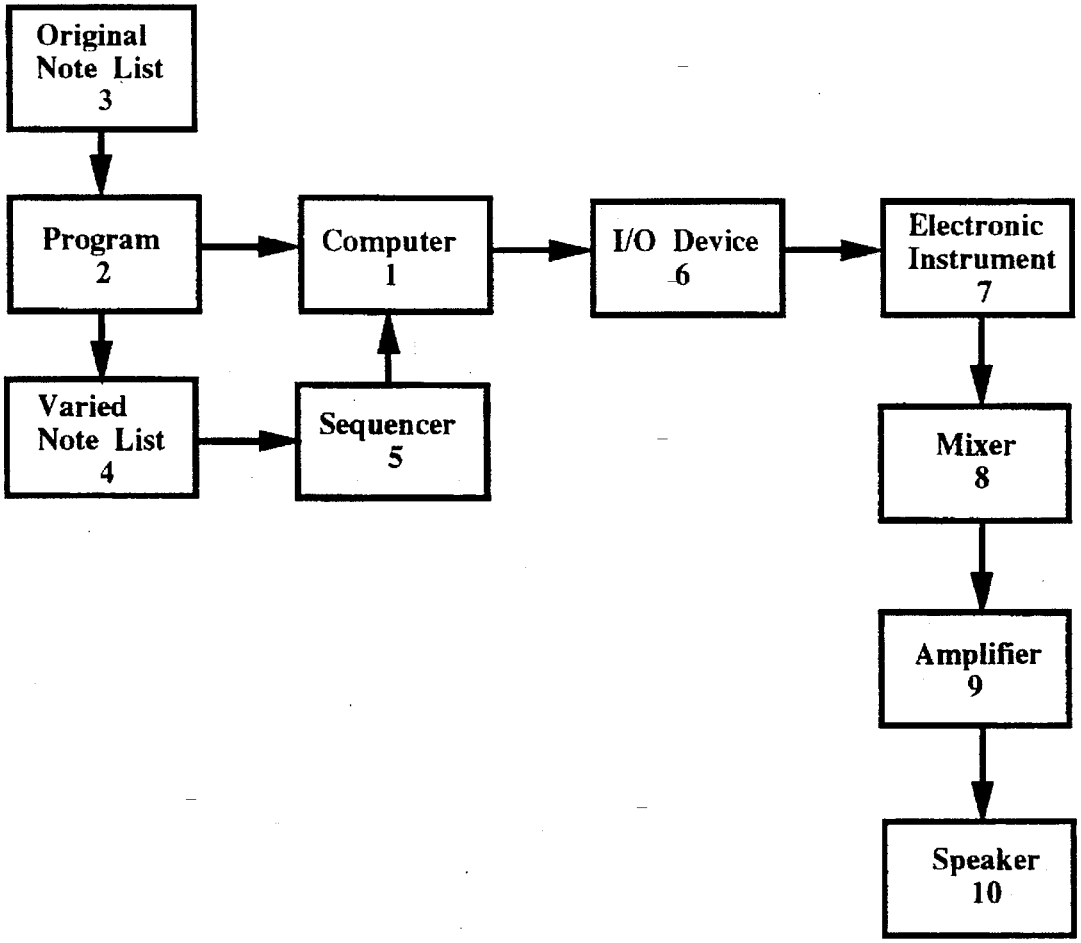

Figure 4: A 4th-Order Runge-Kutta Algorithm.

1.

$$\begin{aligned} funcx &= \sigma(y-x) \\ funcy &= rx - y - xz \\ funcz &= xy - bz \end{aligned}$$

2. Specify parameter values $\sigma$, $b$, and $r$. Also specify the initial conditions $x = x_0$, $y = y_0$, and $z = z_0$, the step size $h$, and the number of steps $N$. Initialize time $t = 0$ and counter $i = 0$.

3. While $i \leq N$, do:

$$\begin{aligned} k1x &= funcx(x, y, \sigma) \\ k1y &= funcy(x, y, z, r) \\ k1z &= funcz(x, y, z, b) \end{aligned}$$

$$\begin{aligned} k2x &= funcx(x + h * k1x/2, y + h * k1y/2, \sigma) \\ k2y &= funcy(x + h * k1x/2, y + h * k1y/2, z + h * k1z/2, r) \\ k2z &= funcz(x + h * k1x/2, y + h * k1y/2, z + h * k1z/2, b) \end{aligned}$$

$$\begin{aligned} k3x &= funcx(x + h * k2x/2, y + h * k2y/2, \sigma) \\ k3y &= funcy(x + h * k2x/2, y + h * k2y/2, z + h * k2z/2, r) \\ k3z &= funcz(x + h * k2x/2, y + h * k2y/2, z + h * k2z/2, b) \end{aligned}$$

$$\begin{aligned} k4x &= funcx(x + h * k3x/2, y + h * k3y/2, \sigma) \\ k4y &= funcy(x + h * k3x/2, y + h * k3y/2, z + h * k3z/2, r) \\ k4z &= funcz(x + h * k3x/2, y + h * k3y/2, z + h * k3z/2, b) \end{aligned}$$

$$\begin{aligned} x &= x + (h * (k1x + 2 * k2x + 2 * k3x + k4x)/6) \\ y &= y + (h * (k1y + 2 * k2y + 2 * k3y + k4y)/6) \\ z &= z + (h * (k1z + 2 * k2z + 2 * k3z + k4z)/6) \\ t &= t + h \\ i &= i + 1 \end{aligned}$$

Figure 5: An Exemplary Algorithm of the Chaotic Mapping.
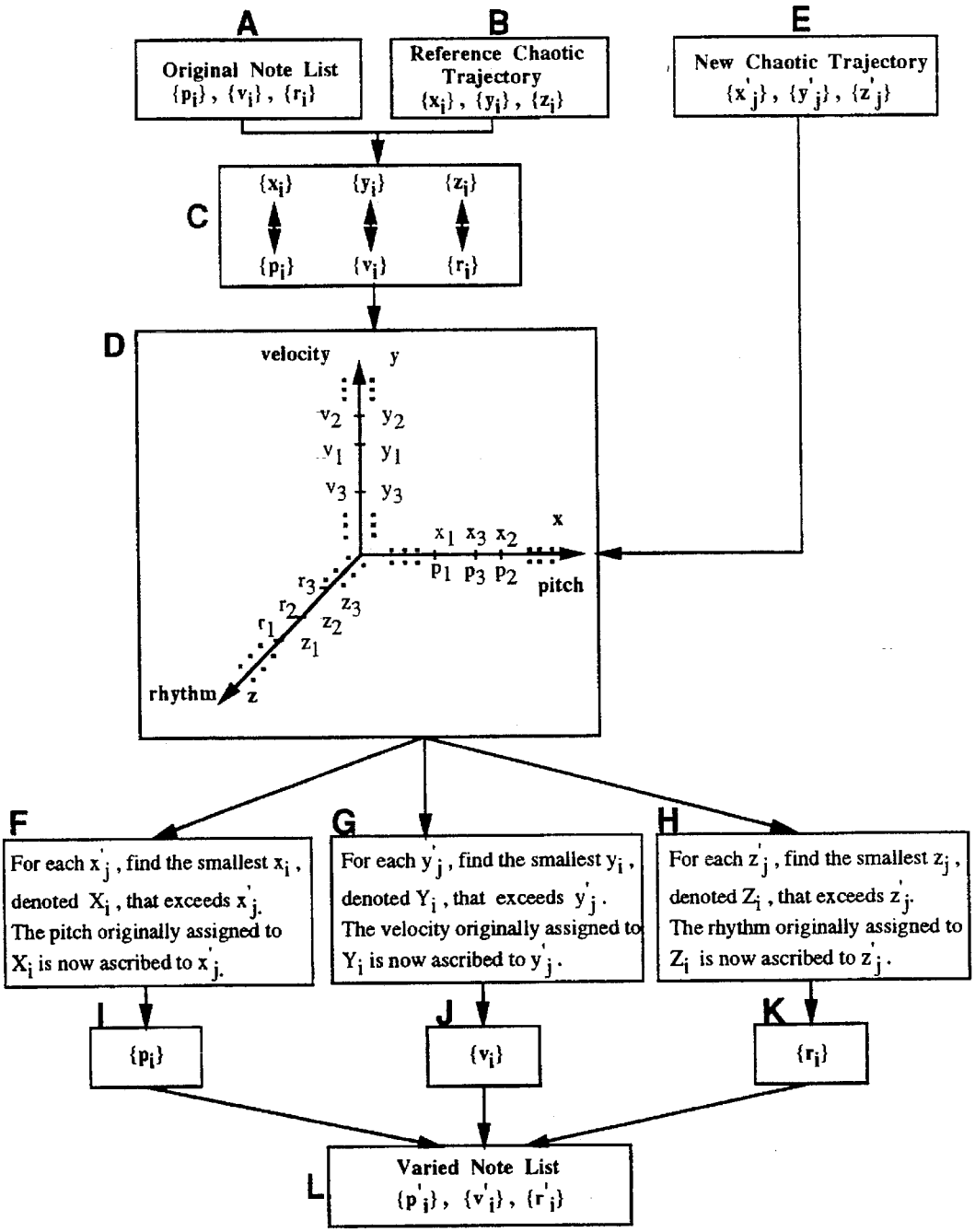

METHOD OF AND APPARATUS FOR COMPUTER-AIDED GENERATION OF VARIATIONS OF A SEQUENCE OF SYMBOLS, SUCH AS A MUSICAL PIECE, AND OTHER DATA, CHARACTER OR IMAGE SEQUENCES

The present invention relates to computer-aided techniques and apparatus for developing variations in an original sequence of data, characters, images, music or other sound lines, or the like, all hereinafter sometimes generically referred to as "symbols"; being more specifically directed to a method particularly, though not exclusively, adapted to enable generating variations of a musical piece that can retain a stylistic tie, to whatever degree desired, to the original piece, or mutate even beyond recognition, through appropriate choice of so-called chaotic trajectories with predetermined initial conditions (IC).

BACKGROUND

Variation has played a large role in science and art. Scientists have spent much of their time explaining the changing nature of countless aspects of the world and its universe. To create variations in systems under study or design, scientists and engineers have had to think through the desired variations and enact them by hand. In recent years, computers have aided this process, by making the enactment process faster. For instance, an engineer could first simulate a design which had been changed from the original, thus testing it before having to spend money building something which might not be as good as the original. But the changes, or variations, in that design would first have to be conceived or modeled by the engineer.

Similarly, musical variations occur because the artist has created them, either by hand, or with the aid of computer programs. The computer may introduce elements of randomness or use tightly (or loosely) controlled parameters to add extra components to the work at hand. The methods employed, however, are often narrow in scope, having been designed by and for individuals and their respective projects. These earlier approaches do not accommodate the disparate styles of composers today. As a simple example, consider an opening and closing filter used to change the timbre of a sound collage. This provides variations on the original sound piece, but it is not suitable for a wide range of musical taste.

The technique proposed in accordance with the present invention, however, generates variations for music of any style, making it a versatile tool for composers wishing to develop their musical material. There is no limit on the number of variations possible. The variations can closely mirror the original work, diverge substantially, or retain some semblance of the source piece, and are created through the use of a mathematical concept, later more fully explained and referenced, involving the mapping of so-called "chaotic" trajectories successively displaced from one another.

OBJECTS OF INVENTION

An object of the present invention, accordingly, is to provide a new and improved method of, and alternatives for, computer-aided generation of variations in musical pieces or note sequences through the use of such chaotic trajectories.

A further object is to provide such a novel technique that is also more generically applicable to other types of sequences of symbols, as well.

Other and further objects will be explained hereinafter and are more particularly delineated in the appended claims.

SUMMARY

In summary, however, from one of its viewpoints as applied to the illustrative application to musical variations, the invention embraces a method of producing variations of an original musical composition, constituted of a sequence of successive musical pitches p occurring one after another in such original piece and including, where desired, one or more chord events; said method comprising, generating in a computer a reference chaotic trajectory representing dynamic time-changing states in x, y, and z space; developing a list of successive x-components for the trajectory and pairing the same with corresponding successive pitches p in similar time sequence; plotting each such pitch p at its x-component location to produce successive pitch domains creating a musical landscape of the original piece along the x axis; generating a second chaotic trajectory initially displaced from the reference chaotic trajectory in x, y, and z space; developing a further list of successive x' components for the second trajectory; seeking for each such x'-component a corresponding x-component that is close thereto; pairing each such x' component with the pitch p that was paired with the corresponding close x-component to create a corresponding pitch p' in a resulting sequence of pitches that is modified and represents a variation upon the original piece. Preferred and best mode designs, techniques and implementations are hereinafter described.

PREFERRED EMBODIMENT(S) OF INVENTION

Before proceeding to a description of the implementation of the invention, illustratively described in its application to music, a review of the mathematical underpinnings of the invention is believed conducive to an understanding of its workings.

As before stated, the technique of the invention uses a "chaotic" system to produce variations. A definition of chaos must include the following four points:

- A chaotic system is nonlinear.
- It is deterministic, i.e., governed by a set of n-dimensional equations such that, if the initial condition (IG) is known exactly, the behavior of the system can be predicted.
- However, the solution to a chaotic set of deterministic equations is highly dependent on the initial conditions, due to the presence of a positive Lyapunov exponent. As a result, nearby trajectories differ from one another.
- A chaotic system exhibits a periodic long-term behavior, meaning that as t approaches ∞, trajectories exist which can never be classified as periodic orbits, quasiperiodic orbits or fixed points.

Thus chaos is a periodic long-term behavior in a nonlinear deterministic system whose solution (1) shows an extreme sensitivity to the initial condition, and (2) wanders endlessly, never exactly repeating, as more fully described, for example, by Strogatz, S., in *Nonlinear Dynamics and Chaos*, Addison-Wesley, N.Y., 1994. The term strange attractor is defined as an attractor exhibiting sensitive dependence on the initial condition, where attractor is defined as a closed set A with the following properties:

- A is invariant. Thus any trajectory x(t) starting on A remains in A for all time.

A attracts an open set of initial conditions. If x(0) is in U, an open set containing A, then the distance from x(t) to A approaches zero as t approaches ∞. Thus A attracts all orbits that start sufficiently close to it. The largest such U is known as the basin of attraction of A.

A is minimal. That is, there is no proper subset of A that satisfies the above properties.

The term chaotic trajectory for a dissipative (or non-Hamiltonian) chaotic system, is defined as one whose initial condition lies within the basin of attraction (a small neighborhood) of the strange attractor.

A chaotic trajectory for a conservative (or Hamiltonian) system is one whose initial condition lies within the stochastic sea, not in the islands of regular motion, as described in Hénon, M., "Numerical exploration of Hamiltonian systems" in G. Iooss, R. H. G. Helleman and R. Stora, eds. *Chaotic Behavior of Deterministic Systems* (North-Holland, Amsterdam).

With the above in mind, it may now be shown how a chaotic mapping provides a technique for generating musical variations of an original work. This technique, based on the sensitivity of chaotic trajectories to initial conditions, produces changes in the pitch sequence of a piece. For present purposes, pitch alone will be considered.

The mapping takes the x-components $\{x_i\}$ of a chaotic trajectory from the Lorenz system, as described by Lorenz, E. N., *J. atmos. Sci.* 20 130–141 (1963), and by Sparrow, C. *The Lorenz Equations: Birfurcations, Chaos, and Strange Attractors* (Springer, New York, 1982). It assigns them to a sequence of musical pitches $\{P_i\}$. Each $P_i$ is marked on the x axis at the point designated by its $x_i$. In this way, the x axis becomes a pitch axis configured according to the notes of the original composition.

Then, a second chaotic trajectory, whose initial condition differs from the first, is launched. Its x-components trigger pitches on the pitch axis that vary in sequence from the original work, thus creating a variation. An infinite set of these variations is possible, regardless of musical style; many are delightful, appealing to musicians and non-musicians alike.

This technique works well because (1) chaotic trajectories vary from one another due to their sensitive dependence property, thus providing built-in variability, and (2) they are sent through a musical landscape which is determined by the notes of the original work, thus preserving the pitch space of the source piece.

All chaotic trajectories are simulated using a fourth order Runge-Kutta implementation of the Lorenz equations $$\frac{dx}{dt} = \sigma(y - x) \tag{1}$$

$$\frac{dy}{dt} = rx - y - xz \tag{2}$$

$$\frac{dz}{dt} = xy - bz, \tag{3}$$

with step size h=0.01 and Lorenz parameters σ=10, r=28, and b=8/3. However, other numerical implementations could be used. Furthermore, the technique is not limited to the Lorenz system, but can be enacted with any chaotic system, whether continuous or discrete, conservative or dissipative, Hamiltonian or non-Hamiltonian), or any system (whether continuous or discrete, conservative or dissipative, Hamiltonian or non-Hamiltonian) that exhibits sensitive dependence on initial conditions, or any system (whether continuous or discrete, dissipative or conservative, non-Hamiltonian or Hamiltonian) that exhibits transient behavior or instability. For non-Hamiltonian systems, behavior near, but not on, limit cycles, fixed points and tori can also produce variations.

DRAWINGS

The invention will now be described with reference to the accompanying drawings.

FIG. 1 is a mapping diagram, in accordance with the invention, applied to an illustrative and later-described piece of music by J. S. Bach;

FIGS. 2*a*–2*d* show the musical scores of the original piece and the three variations produced by the invention;

FIG. 3 is a block diagram of the basic components of an apparatus for practicing the invention;

FIG. 4 gives a fourth order Runge-Kutta algorithm that generates chaotic trajectories from the Lorenz system for use in FIG. 5; and FIG. 5 is a flow diagram of a preferred algorithmic flow chart for use in FIG. 3.

FIG. 1 illustrates the mapping or plotting that, in accordance with the method of the invention, creates the variations. First, a chaotic trajectory with an initial condition (IC) of (1, 1, 1) is simulated using a fourth order Runge-Kutta implementation of the above Lorenz equations, later more fully discussed in connection with FIG. 4, with step size h=0.01 and Lorenz parameters r=28, σ=10, and b=8/3. This chaotic trajectory serves as the reference trajectory. Let the sequence $\{x_i\}$ denote the x-values obtained after each time step (FIG. 1*a*). Each $x_i$ is mapped to a pitch $p_i$ from the pitch sequence $\{p_i\}$(FIG. 1*b*) heard in the original work. For example, the first pitch $p_1$ of the piece is assigned to $x_1$, the first x-value of the reference trajectory; $p_2$ is paired with $x_2$, and so on. The mapping continues until every $p_i$ has been assigned an $x_i$ (FIG. 1*c*). Next, a new trajectory is started at an IC differing from the reference (FIG. 1*d*), and thus initially displaced from the first trajectory. The degree of displacement, slight or larger, controls the degree of original piece variation sought. Each x-component $x'_j$ of the new trajectory is compared to the entire sequence $\{x_i\}$ in order to find the smallest or closest $x_i$, denoted $X_i$, that exceeds $x'_j$. The pitch originally assigned to $X_i$ is now ascribed to $x'_j$. (FIG. 1*e*) The above process is repeated, producing each pitch of the new variation. Sometimes the new pitch agrees with the original pitch ($p'_i=p_i$); at other times they differ ($p'_i \neq p_i$). This is how a variation can be generated that still retains the flavor of the source piece.

To demonstrate the method, consider the first two phrases (11 measures) of Bach's Prelude in C Major (FIG. 2*a*), from the *Well-tempered Clavier, Book I* (WTC I), as the source piece on which two variations are to be built. All note durations have been left out to emphasize that only pitch variations are being considered and created. A strong harmonic progression, analogous to an arpeggioed 5-part Chorale, underlies the Bach Prelude. Variation 1 (FIG. 2*b*) introduces extra melodic elements: the D4 appoggiatura (a dissonant note on a strong beat) of measure (m.) 1; the departure from triadic arpeggios within the first two beats of m. 2; the introduction of a contrapuntal bass line (A2, B2, C3, E3) on the offbeat of m. 5; and the passing tone on F4 heard in m. 7 resolving to E4 in m. 8. All these devices were familiar to composers of Bach's time.

Variation 2 (FIG. 2*c*) evokes the Prelude, but with some striking digressions; for instance, its key is obfuscated for the first half of the opening measure. Compared to Variation 1, Variation 2 departs further from the Bach. This is to be expected: The IC that produced Variation 2 is farther from the reference IC, than the IC that produced Variation 1.

The original Bach Prelude exhibits three prevailing time scales. The slowest is marked by the whole-note because the harmony changes only once per measure. The fastest time scale is given by the sixteenth-note which arpeggios or "samples" the harmony of the slowest time scale. The half-note time scale represents how often the bass is heard, i.e., the bass enters every half-note until the last three bars, when it occurs on the downbeat only. Variation 3 (FIG. 2*d*) alters all three time scales to a greater extent than the previous variations.

This variation also indicates what can occur if an $x'_j$ exists for which there is no $X_i$. Specifically, $x'_{36}$ of Variation 3 exceeded all $\{x_i\}$, resulting in no pitch assignment for $x'_{36}$. In this case, a pitch ($x'_{36}$=D4) was inserted by hand to preserve musical continuity.

Returning to FIG. 1, a more detailed explanation is now given that illustrates the mapping that generated the first 12 pitches of Variation 1.

(Variation 1 is notated in FIG. 2*b*).

(a) Laying down the x scale. The first 12 x-components $\{x_i\}$, i=1, . . . , 12, of the reference trajectory starting from the IC (1,1,1), are marked below the x axis (not drawn to scale). Two additional x-components, that will later prove significant, are indicated: $x_{93}$=15.73 and $x_{142}$=−4.20.

(b) Establishing the p scale. The first 12 pitches of the Bach Prelude are marked below the pitch axis. The order in which they are heard is given by the index i=1,. . ., 12. Note that the 93rd and 142nd pitches of the original Bach are also given.

(c) Linking the x and p scales. Parts (a) and (b) combine to give the explicit mapping. The configuration of the x/pitch axis associates each $x_i$ of the reference trajectory with a $p_i$ from the pitch sequence.

(d) Entering a new trajectory. The first 12 x'-components of the new trajectory starting from the IG (0.999, 1, 1) are marked below the x' axis (not drawn to scale). Their sequential order is indicated by the index j=1, . . . ,12. Those $x'_j \neq x_i$, i=j, are starred.

(e) Creating a variation. Given each $x'_j$, find the smallest $x_i$, denoted $X_i$, that exceeds $x'_j$ (closet to it). For example, $x'_1=0.999 \leqq X_1=1.00$, the pitch C3, originally mapped to $x_1=1.00$, is assigned to $x'_1=0.999 \rightarrow$C3, FIG. 1*c*. All pitches remain unchanged from the original, i.e., all $p'_i=p_i$, until the ninth pitch. Because $x'_9=15.27 \leqq X_{93}=15.73$, $x'^1{}_9$ adopts the pitch D4 that was initially paired with $x_{93}$. The tenth and eleventh pitches of Variation 1 replicate the original Bach, but the twelfth pitch, E3, arises because $x'_{12} \leqq X_{142}=-4.20 \rightarrow$E3.

(f) Hearing the variation. The variation is heard by playing back $P'_i$ for i=1, . . . ,N, where N=176, the number of pitches in the first 11 measures of the Bach.

The before-described two variations of FIGS. 2*b* and 2*c* were obtained as follows, being built upon the same first eleven measures of the original 35-measure Bach Prelude (shown in FIG. 2*a*.) The Runge-Kutta solutions for both reference and new trajectories complete 8 circuits around the Lorenz attractor's left lobe and 3 about the right lobe. The simulations advance 1000 time steps with h=0.01. They are sampled every 5 points (5=[1000/176], where [·] denotes integer truncation and 176=N, the number of pitches in the original). All computations are double precision; the x-values are then rounded to two decimal places before the mapping is applied. Variation 1, of FIG. 2*b*, is built from chaotic trajectories with new IC (0.999, 1, 1) and reference IC (1, 1, 1).

Variation 2, of FIG. 2*c*, is built from chaotic trajectories with new IC (1.01, 1, 1) and reference IC (1, 1, 1). Like Variation 1, Variation 2 introduces musical elements not present in the source piece, e.g., the melodic turn (F4, G3, E4, F4, G4, A3, F4) heard through beats three and four of m. 3, with the last F4 remaining unresolved until the second beat of m. 4. Unlike Variation 1, Variation 2 consistently breaks the pattern of the Prelude—where the second half of each measure replicates the first half—by introducing melodic figuration and superimposed voices. For instance, note the bass motif of m. 6–8 (E3, B2, C3, A2, D3, C3, B2) and the soprano motif of m. 9–11 (D4, A4, G4, D4, A4, G4, A4, B3, E4, B3, D4). Each is indicated by double stems, i.e., two stems that rise (fall) from the note head.

In FIG. 2*d*, the pitch sequence of Variation 3 has durations suppressed. The mapping was applied to all N=549 pitches of the complete 35-measure Prelude, with trajectories having reference IC (1, 1, 1) and new IC (0.9999, 1, 1). The Runge-Kutta solutions for both encircle the attractor's left lobe 5 times and the right lobe twice. The simulations advance 549 time steps with h=0.01, and are sampled every step. All computations are double-precision, with x-values rounded to six decimal places before the mapping is applied.

The half-note time scale is first disturbed in m. 3, where a jazz-like passage replicates the original bass on the downbeat, then inserts the next bass pitch (G1) on the offbeat of beat 3. Measure 4 alters the whole-note time scale by possessing two harmonies m the dominant and the dominant of the dominant—rather than the original's one harmony per measure.

The fastest time scale is disrupted by melodic lines emerging from the sixteenth-note motion. They interfere with the sixteenth-note time scale because, as melodies, they possess a rhythm (or time scale) of their own. Examples of these musical motives are indicated by double stems in m. 7–8, 11–12, 22, and 27–29. In the latter, imitative melodic fragments answer one another.

The last pitch event of the Bach Prelude is a 5-note C major chord, at N=545. The mapping could assign all or part of this chord to $x_N$v. However, to avoid a C major chord interrupting the variation midway, each pitch of the chord was assigned to $x_{545}$, . . . so that N=549. This produced the five pitches (F3, C3, F3, B3, C4) of the last measure. More generally, any musical work that contains pitches simultaneously struck together, can generate variations via a mapping that assigns any or all of the chord to one or more $x_i$.

FIG. 3 gives a block diagram of the type of apparatus that may implement the invention using the chaotic trajectory technique explained above. A computer 1 is provided with a program 2 which includes a simulation of a chaotic system and code that implements the mapping to create the variations, in accordance with the invention.

A note list 3, consisting of every pitch, velocity, and rhythm in the original musical piece, is provided as input to the program 2. A musical sequencer 5 plays the varied note list 4 which emerges from the chaotic mapping. An I/O device 6 allows the computer 1 and/or sequencer 5 to activate sounds on an electronic or acoustic instrument 7 via MIDI (Musical Instrument Digital Interface) or some other communication protocol. The signal is heard by sending it through a mixer 8, amplifier 9, and speaker 10. If a sequencer is unavailable, a musical instrument is needed so that a musician can play the variation directly from reading the note list.

In practice, a code that simulates the chaotic trajectories can also be written in a number of different ways. A fourth order Runge-Kutta algorithm that solves the Lorenz equations is given in FIG. 4, as before mentioned.

The code that implements the chaotic mapping can be written in myriad ways. An exemplary algorithm is shown in FIG. 5. A note list (Block A) of the original piece consisting of sequences of pitches $p_i$, velocities $vi_i$, and rhythms $r_i$, is paired with the x-values, y-values, and z-values of the reference chaotic trajectory (Block B) to form the pairings given in Block C. [N.B.: Velocity denotes how soft or hard a pitch is sounded, ranging from 1 (softest) to 127 (loudest).]

Next, as shown in (Block D), each $p_i$ is marked on the x axis at the location designated by its $x_i$, as also in FIG. 1*c* before described. Each $v_i$ is marked on the y axis at the location designated by its $y_i$. Each $r_i$ is marked on the z axis at the location designated by its $z_i$. In this way, the x axis becomes a pitch axis configured according to the pitches of the original composition. The y axis becomes a velocity axis configured according to the velocities of the original composition. The z axis becomes a rhythmic axis configured according to the rhythms of the original composition. Note that each $x_{i+1}$ is not necessarily greater than $x_i$. (See part (c) of FIG. 1.) Nor is $y_{i+1}$ ($z_{i+1}$) necessarily greater than $y_i$ ($z_i$).

Then, a new chaotic trajectory is launched (Block E). Its x-components trigger pitches on the pitch axis that vary in sequence from the original work, thus creating a variation with respect to pitch. Its y-components trigger velocities on the velocity axis that vary in sequence from the original work, thus creating a variation with respect to velocity. Its z-components trigger rhythms on the rhythmic axis that vary in sequence from the original work, thus creating a variation with respect to rhythm.

More specifically, as described in Block F, each x-component $x'_j$ of the new trajectory is compared to the entire sequence $\{x_i\}$ in order to find the smallest $x_i$, denoted $X_i$, that exceeds $x'_j$, as in previously described FIG. 1*e*. The pitch originally assigned to $X_i$ is now ascribed to $x'_j$. The above process is repeated, producing each pitch of the new variation (Block I).

As described in Block G, each y-component $y'_j$ of the new trajectory is compared to the entire sequence $\{y_i\}$ in order to find the smallest $y_i$, denoted $Y_i$, that exceeds $y'_j$. The velocity originally assigned to $Y_i$ is now ascribed to $y'_j$. The above process is repeated, producing each velocity of the new variation (Block J).

As described in Block H, each z-component $z'_j$ of the new trajectory is compared to the entire sequence $\{z_i\}$ in order to find the smallest $z_i$, denoted $Z_i$, that exceeds $z'_j$. The rhythm originally assigned to $Z_i$ is now ascribed to $z'_j$. The above process is repeated, producing each rhythm of the new variation (Block K).

Sometimes the new pitch agrees with the original pitch ($p'_i=p_i$); at other times they differ ($p'_i\neq p_i$). And/or, sometimes the new velocity agrees with the original velocity ($v'_i=v_i$); at other times they differ ($v'_i\neq v_i$). And/or, sometimes the new rhythm agrees with the original rhythm ($r'_i\neq r_i$); at other times they differ ($r'_i\neq r_i$). This is how a variation (Block L) can be generated that still retains the flavor of the original piece.

By extending the mapping to the V and z axes, variations can thus also be generated that differ in other characteristics, such as rhythm and dynamic level (i.e., loudness), as above illustrated, as well as the pitch. Although the Lorenz system can exhibit periodic behavior, the mapping is most effective with chaotic trajectories. This is due to their infinite length, enabling music of any duration to be piggybacked onto them, and their extreme sensitivity to the IC.

To show the drawback of limit cycle behavior, indeed, the same methods discussed in FIGS. 1 and 2 were applied to orbits near the limit cycle for r=350 in FIG. 4. The IC, (−8.032932, 44.000195, 330.336014) is on the cycle (approximately). In this case however, if a trajectory starting at that IC serves as the reference for the mapping, a new trajectory, with its IC obtained by truncating the last digit of the reference IC, yields the original Prelude. That is, the IC (−8.03293, 44.00019, 330.33601) does not give a variation. (But if the x-values are rounded to more than two decimal places, small changes in the pitch sequence do arise.)

Considering the chaotic regime (for r=28 in FIG. 4), where the IC (5.571527 −3.260774 35.491472) is on the strange attractor (approximately), if this IC is used for the reference trajectory, and the same IC with the last digit truncated starts the new trajectory, a distinct variation results.

Behavior in a system with a chaotic regime can yield variations, even when system parameters are set for non-chaotic behavior. This is due to the intermittency inherent in a chaotic system. Intermittency is defined as nearly periodic motion interrupted by occasional irregular bursts. The time between bursts is statistically distributed, in the manner of a random variable, despite the fact that the system is completely deterministic. As the control parameter is moved farther away from the periodic window of behavior, the bursts occur more frequently until the system is fully chaotic. This progression of events is known as the intermittency route to chaos, as described in the beforementioned Strogatz book.

Commonly arising in systems where the transition from periodic to chaotic motion happens via a saddle-node bifurcation of cycles, intermittency occurs in the Lorenz equations. For example, if r=166 in FIG. 4, all trajectories are attracted to a stable limit cycle. But if r=166.2, the trajectory resembles the former limit cycle for much of the time, but occasionally it is disturbed by chaotic bursts—a signature of intermittency, as described in Strogatz.

Behavior near attractors present in a non-chaotic system of equations (e.g., the Van der Pol equation) may still give some variation, depending on the transient or instabilities present in the system.

APPLICATION

As before discussed, by extending the mapping to the y and z axes, variations can be generated that differ, for example, in rhythm and dynamic level (i.e., loudness), as well as pitch.

Variations can be made on virtually any application which could be modeled, however loosely, as a dynamic system. By identifying the state variable(s) to be varied, one can map it (them) to the reference chaotic trajectory. Each state $u_i$ ($v_i$, $w_i$) of the state variable(s) would then be marked on the x (y, z) axes at the point designated by its $x_i$ ($y_i$, $z_i$). Then a new trajectory, whose initial condition differs from the reference, would trigger states on the x (y, z) axes that vary in sequence from the original, resulting in a variation.

Classical music is sometimes called a dead art today, especially in the United States. By enabling students K-12 to choose a piece of classical music they like, and letting them explore ways to interactively vary that piece, new listeners of the classics can learn the repertoire and also relate more closely to it—achieving a deeper connection with each new piece, as they creatively explore the variations they make. Those people who like rock, jazz and other genres, moreover, can also select their favorite songs, and make variations of them, thus forging a creative interactive link, and eliminating passive listening. CD players, indeed, might include a chip that takes a favorite CD and, with the input of the listener, creates variations on one or more of the CD tracks.

Concerts, furthermore, could be presented where members of an audience would hear a different version of the piece, depending on where they sat. For instance, the audience seated in the left balcony of a concert hall would hear a different variation than heard in the right balcony. Then at intermission, each member of the audience could move to another seat in another section of the hall. (Or, with the audience remaining in their original seats, another set of variations could be directed/sent through speakers for the second half of the program or any part thereof.) The first half of the concert would be repeated, with each listener hearing a different variant of the pieces from the first half of the program. This kind of a concert encourages an audience to be active (rather than passive) listeners. Their ability to detect and enjoy the variations depends on how keenly they have heard the first half of the program.

While described in connection with music, the method of the invention is more broadly useful with other types of sequences of symbols, as before discussed. As another example of the versatility of the invention, video, animation, computer graphics and/or film events could also usefully employ variants of the works to be presented and section off the audience so that different parts would see and hear different variations of the core works. Then, a change in seating allows a second viewing, but with variational twists. (Or, if the audience remains in their original seats, another set of variations could be directed/sent to the screens, monitors, speakers, and what not, for the second half of the program or any part thereof.) Computer graphic artists may create a work, and by breaking the image into any arrangement of parts (e.g., pixels, grids, color, line, shading), map the parts in a prearranged sequence to a chaotic trajectory. One or more of the axes would become configured according to the information contained in the subdivision of the work. A second trajectory sent through this landscape would be able to trigger these components, but in a different sequence than the original symbols.

Video artists may create a work, then also break the work into any arrangement of frames, and map the frames, or certain key components of them, to a chaotic trajectory, in a pre-arranged (or otherwise selected) sequence. One or more of the axes would become configured according to the information contained in the subdivisions of the work. A second trajectory sent through this landscape would be able to trigger these components, but in a slightly (or substantially) different sequence than the original, by appropriate choice of the initial condition.

Film makers, also, could shoot a film, then break the work into any arrangement of frames, and map the frames or certain key components of them to a chaotic trajectory, in a pre-arranged (or otherwise selected) sequence. One or more of the axes would become configured according to the information contained in the subdivisions of the work. A second trajectory sent through this landscape would be able to trigger these components, but in a slightly (or substantially) different sequence than the original, by appropriate choice of the initial condition.

Multidimensional systems of order n can also be mapped. This can be done by using an nth order chaotic system. It would also be possible to daisy-chain a number of lower order systems, and apply the mapping.

Text (any printed matter, individual words or letters) may also be mapped in sequence to the reference trajectory. The original text would then configure one or more axes of the "state space" through which the new trajectory would be sent, triggering a new sequence of words, letters or printed matter that can be as structurally close or far away from the original as desired, by appropriate choice of the initial condition. These variations on an original text source would serve as idea generators for writers, poets, the advertising industry, journalists, etc.

The invention is also useful for applications in multimedia, holography, video and computer game sequences; the key element about this technique for variations is its ability to preserve the structure of the original while offering a rich set of variations that can retain their stylistic tie to the original or mutate beyond recognition, by appropriate choice of the IC. These variations can then be used "as is" or developed further by the designer.

The mapping of the invention has thus been designed to take as its input, in the exemplary and important application to music, the pitches of a musical work (or section) and outputs variations that can retain their stylistic tie to the original piece or mutate beyond recognition, by appropriate choice of the IC. Other factors affecting the nature and extent of variation are step size, length of the integration, the amount of truncation and round-off applied to the trajectories, intermittency, instabilities, transient behavior, whether the system is dissipative or conservative (Hamiltonian or non-Hamiltonian), the conservative (or Hamiltonian) chaotic approach perhaps involving an instability that serves the same function that intermittency serves with respect to dissipative (or non-Hamiltonian) chaotic systems. All such chaotic trajectories are considered embraced within the invention.

This technique does not compose music; rather, it creates a rich set of variations on musical input that the composer can further develop. Though the method will not flatter fools, it can lead a composer with something compelling to say, into musical landscapes where, amidst the familiar, variation and mutation allow wild things to grow. And, as before explained, the invention is not restricted to music sequences but is more generically applicable.

Further modifications will occur to those skilled in this art and are considered to fall within the spirit and scope of the invention as defined in the appended claims.

What is claimed is:

1. A method of producing variations of an original musical composition, constituted of a sequence of successive musical pitches p occuring one after another in such original piece and including, where desired, one or more chord events, said method comprising, generating in a computer a reference chaotic trajectory representing dynamic time-changing states in x, y, and z space; developing a list of successive x-components for the trajectory and pairing the same with corresponding successive pitches p in similar time sequence; plotting each such pitch p at its x-component location to produce successive pitch domains creating a musical land-scape of the original piece along the x axis; generating a second chaotic trajectory initially displaced from the reference chaotic trajectory in x, y, and z space; developing a further list of successive x'-components for the second trajectory; seeking for each such x'-component a corresponding x-component that is close thereto; pairing each such x'-component with the pitch p that was paired with the corresponding close x-component to create a corresponding pitch p' in a resulting sequence of pitches that is modified and represents a variation upon the original piece.

2. A method as claimed in claim 1 and in which each said x-component that is close to an x'-component represents the smallest x-component that exceeds such x'-component.

3. A method as claimed in claim 2 and in which the paired x'-p' musical landscape is one of: reproduced for playing by a musician, and applied to control an electronic musical instrument to play the same.

4. A method as claimed in claim 1 and in which successive musical characteristics other than pitch are plotted for one of successive y or z-component locations for the reference trajectory, and a further list of successive y' or z'-components for the second trajectory is paired with such characteristics that had been paired with a corresponding y or z-component close thereto.

5. A method as claimed in claim 1 and in which successive dynamic level or degree of loudness is plotted for one of successive y or z-component locations for the reference trajectory, and a further list of successive corresponding y' or z'-components for the second trajectory is paired with the dynamic level or loudness that had been paired with a corresponding y or z-component close thereto.

6. A method as claimed in claim 1 and in which successive rhythms are plotted for one of successive y or z-component locations for the reference trajectory, and a further list of successive corresponding y' or z'-components for the second trajectory is paired with the rhythm that had been paired with a corresponding y or z-component close thereto.

7. A method as claimed in claim 4 and in which the method steps of claim 4 are repeated by reiteration for still additional characteristics, thereby to extend beyond the three dimensions of m, y and z.

8. A method of producing variations of an original sequence of successive symbols, comprising, generating in a computer a reference chaotic trajectory representing dynamic time-changing states in x, y, and z space; developing a list of successive x-components for the trajectory and pairing the same with corresponding successive symbols or characteristics thereof in similar time sequence; plotting each such symbol or characteristic at its x-component location to produce successive symbol domains creating a landscape of the original along the x axis; generating a second chaotic trajectory initially displaced from the reference chaotic trajectory in x, y and z space; developing a further list of successive x'-components for the second trajectory; seeking for each such x'-component a corresponding x-component that is close thereto; pairing each x'-component with the symbol as characteristic that was paired with the corresponding close x-component; pairing each suchx'-component with the symbol or characteristic that was paired with the corresponding close x-component to create a corresponding symbol or characteristic in a resulting modified sequence that is a variation upon the original sequence.

9. A method as claimed in claim 8 and in which further characteristics associated with the original sequence of successive symbols are plotted for one of successive y or z-component locations for the reference trajectory, and a further list of successive y' or z'-components for the second trajectory is paired with such further characteristics that had been paired with a corresponding y or z-component close thereto.

10. A method as claimed in claim 9 and in which the method steps of claim 9 are repeated by reiteration for still additional characteristics, thereby to extend beyond the three dimensions of x, y and z.

11. Apparatus for producing variations of an original musical composition, constituted of a sequence of successive musical pitches p occurring one after another in such original piece and including, where desired, one or more chord events, said apparatus having, in combination, means for generating in a computer a reference chaotic trajectory representing dynamic time-changing states in x, y, and z space; means for developing a list of successive x-components for the trajectory and pairing the same with corresponding successive pitches p in similar time sequence; means for plotting each such pitch p at its x-component location to produce successive pitch domains creating a musical landscape of the original piece along the x axis; means for generating a second chaotic trajectory initially displaced from the reference chaotic trajectory in z, y, and z space; means for developing a further list of successive x'-components for the second trajectory; means for seeking for each such x'-component a corresponding x-component that is close thereto; means for pairing each such x'-component with the pitch p that was paired with the corresponding close z-component to create a corresponding pitch p' in a resulting sequence of pitches that is modified and represents a variation upon the original piece.

12. Apparatus as claimed in claim 11 and in which each said x-component that is close to an x'-component represents the smallest x-component that exceeds such x'-component.

13. Apparatus as claimed in claim 11 and in which means is provided for enabling playing the variation in response to such last-named pairing means.

14. Apparatus as claimed in claim 11 and in which means is provided for plotting successive musical characteristics other than pitch for one of successive y or z-component locations for the reference trajectory, and means for developing a list of successive y' or z'-components for the second trajectory and pairing the y' or z'-components with such characteristics that had been paired with a corresponding y or z-component close thereto.

15. Apparatus as claimed in claim 14 and in which said musical characteristics include one of rhythm and loudness.

16. Apparatus for producing variations of an original sequence of successive symbols, comprising, means for generating in a computer a reference chaotic trajectory representing dynamic time-changing states in x, y, and z space; means for developing a list of successive x-components for the trajectory and pairing the same with corresponding successive symbols or characteristics thereof in similar time sequence; means for plotting each such symbol or characteristic at its x-component location to produce successive symbol domains creating a landscape of the original along the x axis; means for generating a second chaotic trajectory initially displaced from the reference chaotic trajectory in x, y and z space; means for developing a further list of successive x'-components for the second trajectory; means for seeking for each such x'-component a corresponding z-component that is close thereto; means for pairing each such x'-component with the symbol or characteristic that was paired with the corresponding close x-component to create corresponding symbol or characteristic in a resulting modified sequence that is a variation upon the original sequence.

17. A method as claimed in claim 1 and in which the degree of closeness of the variation to the style of the original piece is controlled by controlling the amount of the second trajectory displacement from the reference trajectory.

18. Apparatus as claimed in claim 16 and in which means is provided for controlling the desired degree of closeness of the variation to the original sequence by controlling the amount of the second trajectory displacement from the reference trajectory.

* * * * *